US006068548A

United States Patent [19]

Vote et al.

[11] Patent Number: 6,068,548

[45] Date of Patent: May 30, 2000

[54] MECHANICALLY STABILIZED RETAINING RING FOR CHEMICAL MECHANICAL POLISHING

[75] Inventors: Marion C. Vote; Vance E. Armour, both of Hillsboro, Oreg.

[73] Assignee: Intel Corporation, Santa Clara, Calif.

[21] Appl. No.: 08/992,659

[22] Filed: Dec. 17, 1997

[51] Int. Cl.[7] ..... B24B 5/00; B24B 47/02

[52] U.S. Cl. ..... 451/398; 451/41; 451/287

[58] Field of Search ..... 451/41, 42, 285, 451/287, 390, 397, 398, 402

[56] References Cited

U.S. PATENT DOCUMENTS

| | | | |
|---|---|---|---|
| 5,449,316 | 9/1995 | Strasbaugh | 451/287 |
| 5,533,924 | 7/1996 | Stroupe et al. | 451/286 |
| 5,584,746 | 12/1996 | Tanaka et al. | 451/398 |
| 5,584,751 | 12/1996 | Kobayashi et al. | 451/287 |
| 5,695,392 | 12/1997 | Kim | 451/286 |
| 5,791,975 | 8/1998 | Cesna et al. | 451/287 |
| 5,795,215 | 8/1998 | Guthrie et al. | 451/287 |
| 5,803,799 | 9/1998 | Volodarsky et al. | 451/287 |
| 5,820,448 | 10/1998 | Shamouilian et al. | 451/287 |
| 5,885,135 | 3/1999 | Desorcie et al. | 451/287 |
| 5,906,532 | 5/1999 | Nakajima et al. | 451/287 |

*Primary Examiner*—Derris Holt Banks
*Attorney, Agent, or Firm*—Raymond J. Werner

[57] ABSTRACT

A carrier assembly for chemical mechanical polishing (CMP) includes a retaining ring removably attached to a rigid backing plate. The backing plate provides mechanical support over the entire load bearing surface of the retaining ring. In a further aspect of the present invention, a flexure clamp ring independent of the retaining ring for removably attaching the backing plate to the carrier assembly base Is included as part of the carrier assembly.

7 Claims, 6 Drawing Sheets

MECHANICALLY STABILIZED RETAINING RING FOR CHEMICAL MECHANICAL POLISHING

BACKGROUND OF THE INVENTION

1. Field of the Invention

The present invention relates to the field of semiconductor manufacturing and, more specifically, to an improved apparatus for chemical-mechanical polishing (CMP).

2. Background

Nonplanar surfaces, when present in integrated circuits having complex, high density multilevel interconnections, may cause the optical resolution of photolithographic processing steps to be poor, which could inhibit the printing of high density lines. Non-planar layer surfaces degrade the ability to control linewidths during the photolithographic process. It is thus important, when making such complex integrated circuits, to planarize the surface of many of the layers that make up the integrated circuit.

Various techniques have been developed to planarize certain layers formed during the process of making integrated circuits. In one approach, known as chemical-mechanical polishing (CMP), protruding steps, such as those that may be formed along the upper surface of interlayer dielectrics ("ILDs"), are removed by polishing. Chemical-mechanical polishing may also be used to planarize conformally deposited metal layers to form planar plugs or vias.

CMP may also be used to planarize layers that are typically much thinner than ILDs, for example, polysilicon layers that are used to form gate electrodes or interconnect in Metal Oxide Semiconductor (MOS) processes. Unlike CMP planarization of ILDs where many thousands of Angstroms of material are removed, the deposited thickness of the polysilicon layer in a modern MOS process is typically on the order of a few thousand Angstroms.

CMP generally uses a slurry, which is introduced onto a polishing pad, to achieve the removal of a portion of the surface being polished. When the desired amount of material removal has been achieved, the polished surface must be cleaned to remove contaminants, such as excess slurry particles, that can adversely affect the microelectronic component and interconnect structures that are to be formed subsequent to a particular CMP step.

In a typical CMP system, as shown in FIG. 1, a wafer 102 is placed face down on a rotating table 104 covered with a polishing pad 106, which has been coated with a slurry 108. A carrier 100, which can be made of a thick, substantially rigid metal plate 114 that is attached to a rotatable shaft 105, is used to apply a downward force against the backside of wafer 102. A retaining ring 117 is used to center wafer 102 onto carrier 100 and to prevent wafer 102 from slipping laterally. Typically, the surface of wafer 102 extends outwardly beyond the polishing side surface (i.e., the wear surface) of retaining ring 117. A resilient carrier pad 112 positioned between metal plate 114 and wafer 102, is typically used to press against the backside of wafer 102. Often, plate 114 will be manufactured with a slight convex curvature so as to bend the central portion of a wafer outward. By applying the downward force, and rotating wafer 102, while simultaneously rotating slurry covered pad 106 for a selected amount of time, a desired amount of material may be removed from the upper surface of a thin film such that the surface of wafer 102 is planarized.

Retaining ring 117 is also referred to in the art as a wafer retaining ring, or a wear ring. The polishing side surface of retaining ring 117 is also referred to as the wear surface.

FIG. 2 provides a top view of a conventional CMP system, showing polishing pad 202, retaining ring 204, and slurry delivery arm 206.

During the CMP process, material is removed not only from the surface of the wafer being planarized, but also from the wear surface of retaining ring 117. Moreover, retaining ring 117 tends to wear, sometimes unevenly, thus introducing a source of non-uniformity and non-repeatability into the CMP process. Consequently, retaining ring 117 must be replaced and/or refurbished frequently to maintain the desired level of uniformity and repeatability. Unfortunately, it is a costly process to maintain the wear surface of retaining ring 117 because, the polishing tool must be taken off-line while the carrier is disassembled, the worn ring removed and a new ring installed. Similarly, even though retaining ring 117 may be machined several times to overcome the uneven wearing that results from use, this is also costly because retaining ring 117 is typically made from a very expensive plastic such as polyphenylene sulfide (PPS).

Accordingly, there is a need for CMP methods and apparatus that reduce the cost of semiconductor manufacturing.

SUMMARY OF THE INVENTION

Briefly, a carrier assembly for chemical mechanical polishing (CMP) includes a retaining ring removably attached to a rigid backing plate. The backing plate provides mechanical support over the entire load bearing surface of the retaining ring.

In a further aspect of the present invention, a flexure clamp ring independent of the retaining ring for removably attaching the backing plate to the carrier assembly base Is included as part of the carrier assembly.

DETAILED DESCRIPTION

Slurry refers to an abrasive. A wide variety of well-known slurries can be used for polishing. The actual composition of the slurry depends upon the specific material to be polished. Slurries are generally silica based solutions that have additives dependent upon the type of material to be polished.

Substrate, as used herein, refers to the physical object that is to be planarized by means of the CMP process. A substrate may be a wafer. Wafers, may be made of semiconducting, non-semiconducting, or combinations of semiconducting and non-semiconducting materials. Substrates, such as silicon wafers, may have thin films formed upon them of various materials, including but not limited to oxides, polysilicon, and metals. These thin films may be planarized with CMP processing. Other substrate materials such as GaAs, silicon-on-sapphire, or silicon on insulator (SOI) may be planarized with CMP processing.

Figure 1:
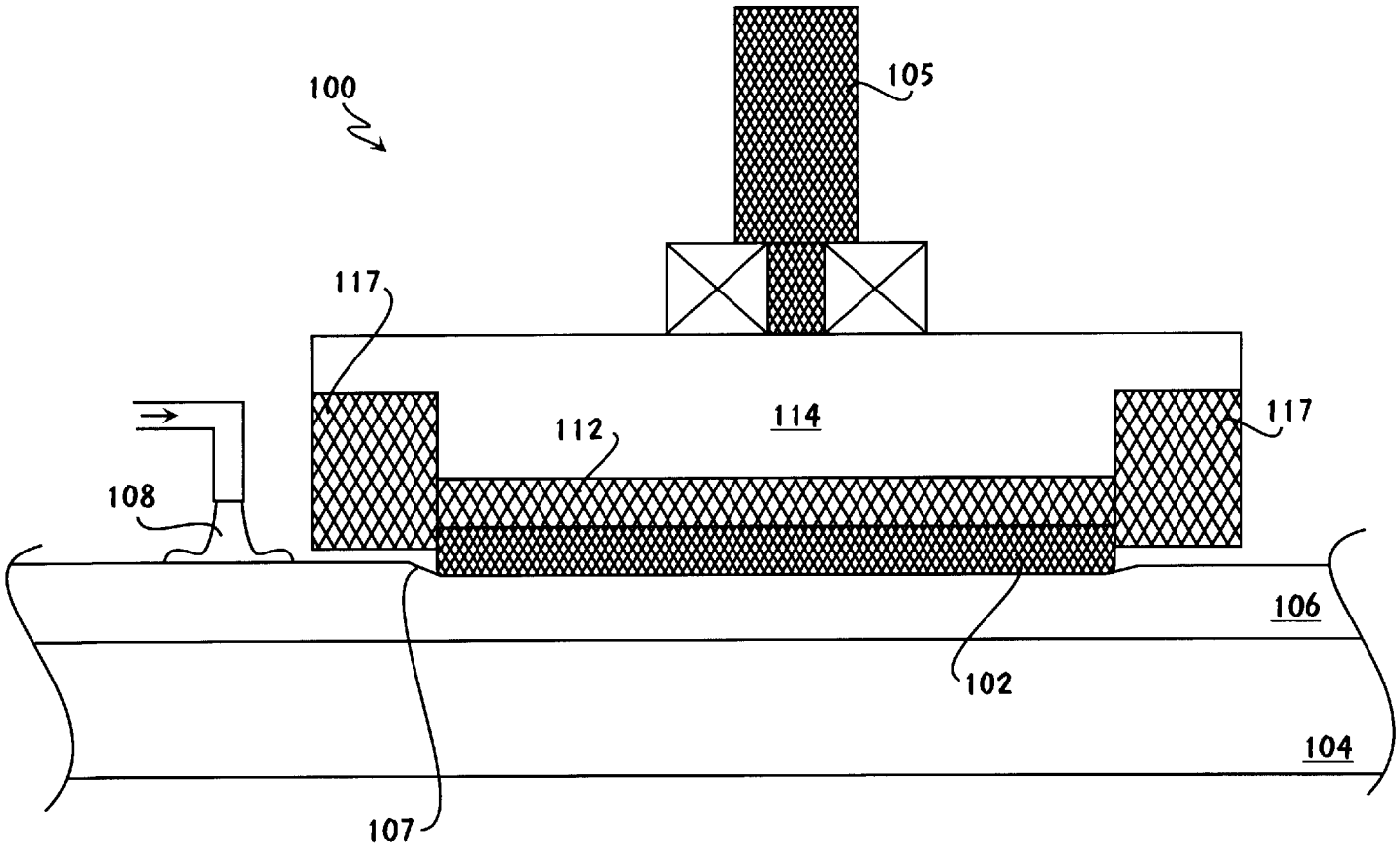
FIG. 1 (PRIOR ART)
FIG. 1 is a cross-sectional view of a CMP apparatus having a conventional retaining ring.
Figure 2:
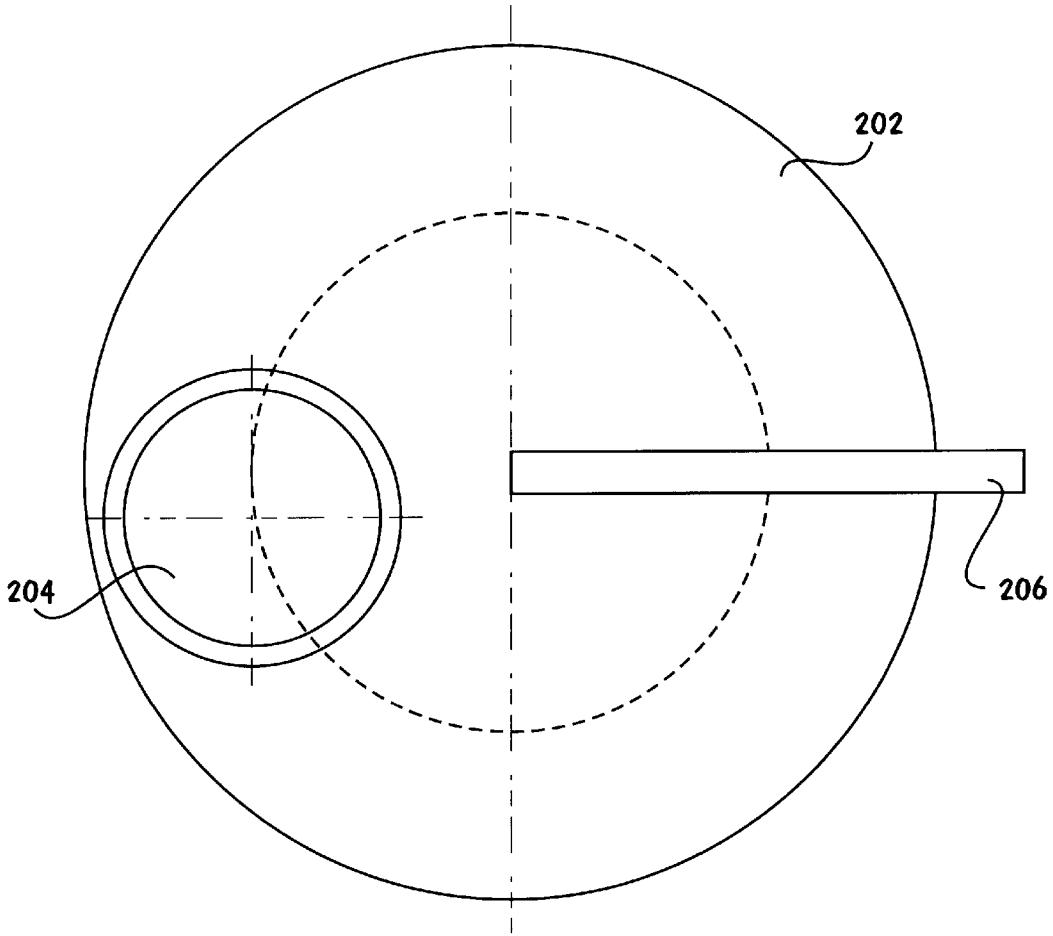
FIG. 2 (PRIOR ART)
FIG. 2 is a top view of a polishing pad covered platen, retaining ring, and slurry delivery arm, indicating the slurry delivery point to the polishing pad.
Figure 3:
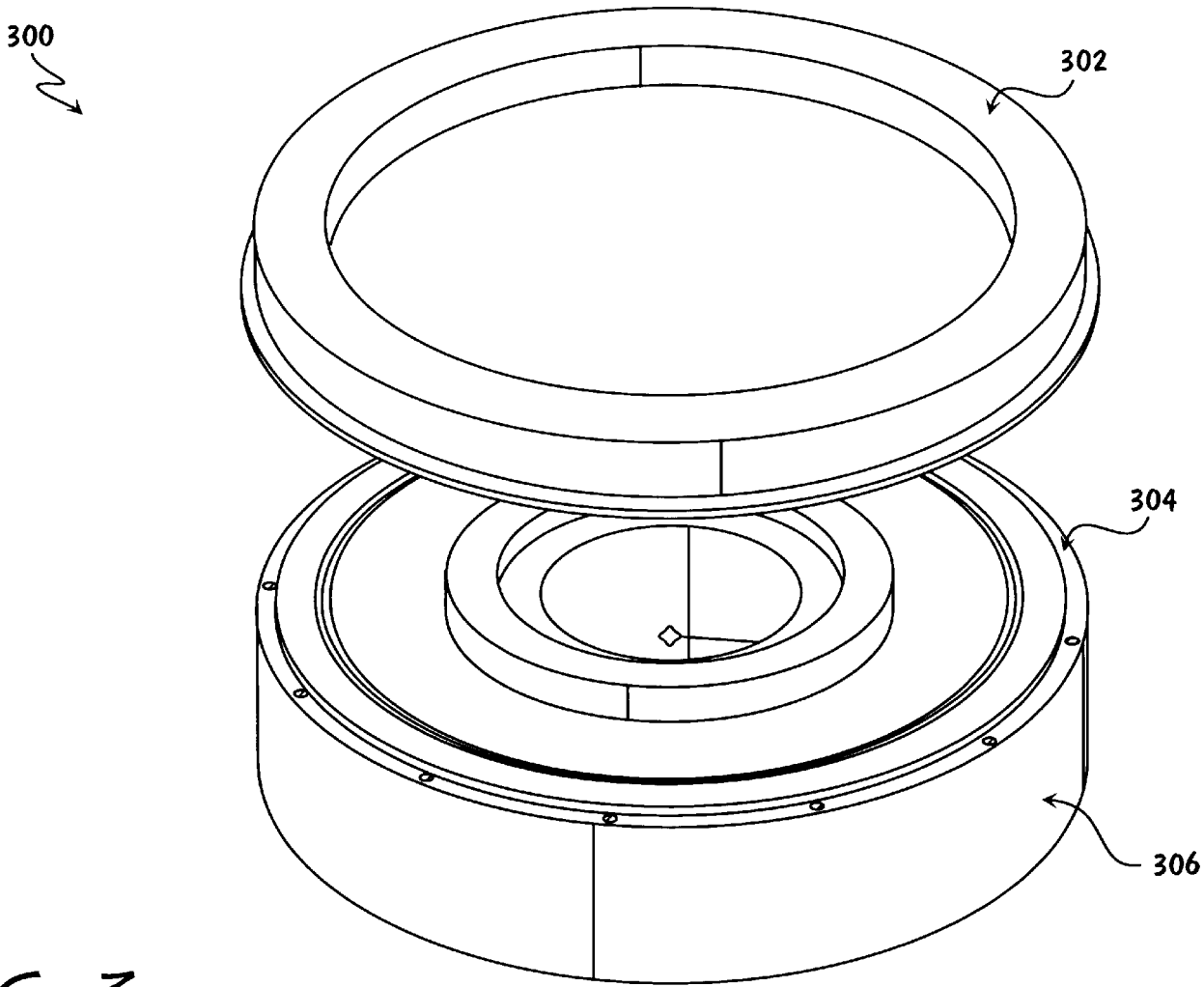
FIG. 3 (PRIOR ART)
FIG. 3 is an exploded view of a prior art CMP carrier assembly.

Referring to FIG. 3, a conventional carrier assembly 300 is shown. Carrier assembly 300 includes a retaining ring 302 that is removably attached to a carrier assembly base 306 at an attach surface 304.

During the process of chemical mechanical polishing, retaining ring 302 is worn down, sometimes in an uneven fashion. Additionally, retaining ring 302 has a tendency to flex during the CMP process. This uneven wear and flexing lead to nonuniformity and unrepeatability in the CMP process. Further, the uneven wear and flexing contribute to a ring dressing effect in which the surface of the polishing pad is abraded in an uncontrolled and unrepeatable manner. Excess pad wear results in higher manufacturing costs since the pads must be replaced more frequently due to wear.

In order to reduce the undesirable effects of uneven retaining ring wear, conventional retaining rings, fixed in the carrier assembly, can be subjected to a lengthy post-assembly lapping procedure. However, post-assembly lapping is costly in terms of time. Additionally, post-assembly lapping results in contamination of the retaining ring with abrasive residue. More particularly, this abrasive residue is embedded in the wear surface of the retaining ring, as well on the exposed surfaces inside the chambers of the carrier assembly. As will be appreciated by those skilled in the art, such particulate contamination has an adverse impact on integrated circuit manufacturing.

A carrier assembly in accordance with the present invention, achieves improved wear surface rigidity by mounting a relatively more flexible retaining ring to a rigid backing plate, typically formed from stainless steel. The backing plate provides mechanical support over the entire backside of the retaining ring.

In a further aspect of the present invention, reliability of a flexure seal is improved by the addition of a rigid clamping ring that clamps the membrane to the carrier assembly. The clamping ring is independent of the more flexible retaining ring.

In still further aspects of the present invention, attachment of the retaining ring to the carrier assembly can be accomplished by using a bolt attachment, a threaded attachment, a quick release clamp ring, a snap ring, or a glue or adhesive.

Figure 4:
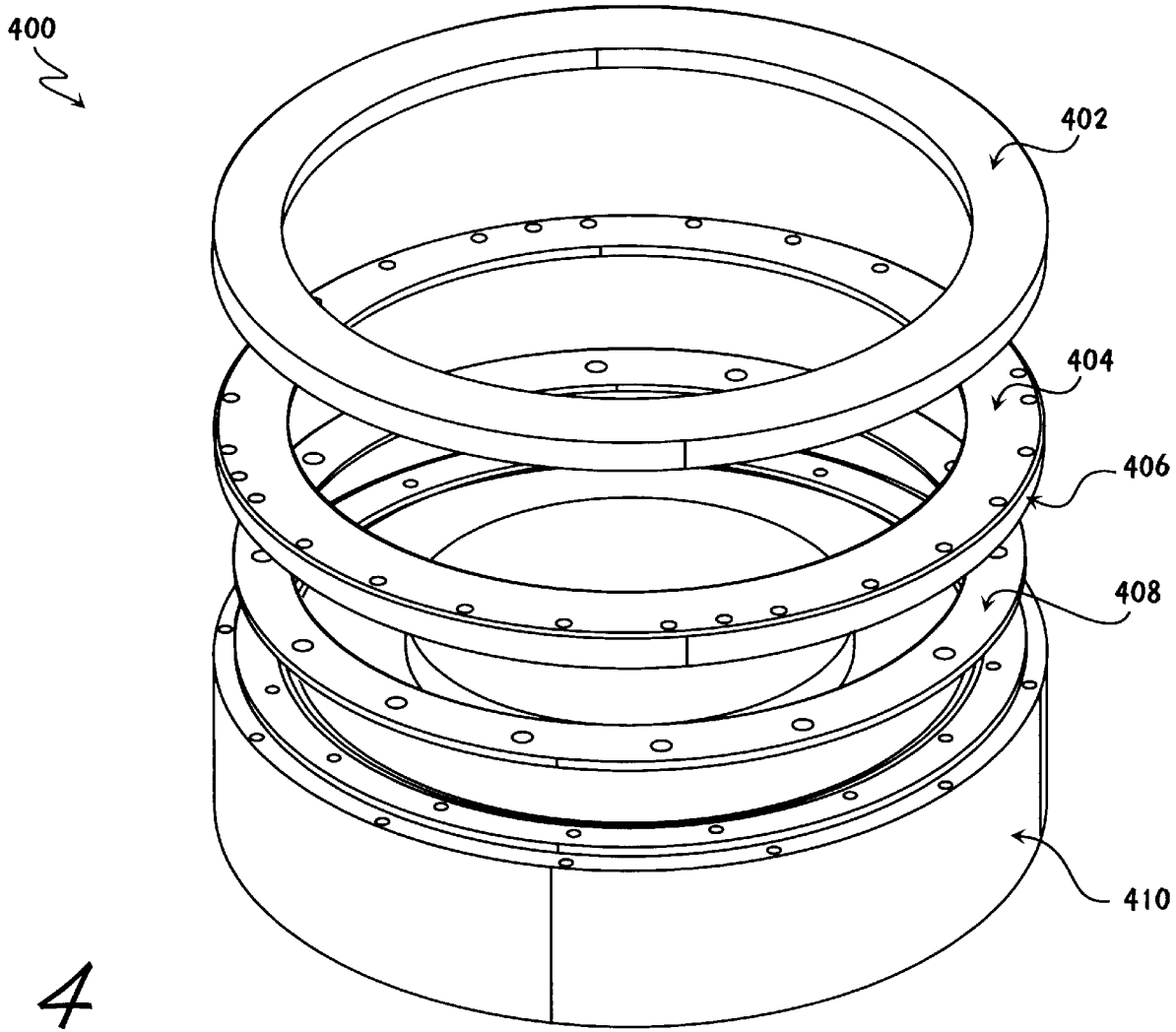
FIG. 4 is an exploded view of a CMP carrier assembly having a mechanically stabilized retaining ring in accordance with the present invention.

Referring to FIG. 4, a carrier assembly 400 in accordance with the present invention is shown. Carrier assembly 400 has a retaining ring 402 that is removably coupled to a retaining ring support area 404. Retaining ring 402 is typically made from a machinable hard plastic such as polyphenylene sulfide (PPS). One form of PPS is manufactured by DSM Engineering Plastic Products Inc., and is known as Techtron ®. Retaining ring 402 may also be formed from other materials, such as, ceramics.

Retaining ring support area 404 is formed on a surface of a backing plate 406. Backing plate 406 has a thickness that ranges from approximately 0.075 inches to an upper limit generally determined by the space constraints of the carrier assembly. In one embodiment of the present invention the backing plate has a thickness of approximately 0.125 inches. Backing plate 406 is typically formed from stainless steel, although other suitably rigid materials, for example ceramics, or metals such as titanium or anodized aluminum, can be used. A desirable characteristic for the material chosen to form backing plate 406 is that it be resistant to corrosion. Similarly, the components of the cattier assembly should not react to slurry.

Retaining ring 402 can be removably coupled to retaining ring support area 404 by screws, adhesive with stabilization pins, a snap lock, or a bayonet lock.

Backing plate 406 is coupled by a flexure retainer 408 to a carrier base 410. Together, retaining ring 402, backing plate 406, flexure retainer 408 and carrier base 410 make up carrier assembly 400.

Figure 5B:
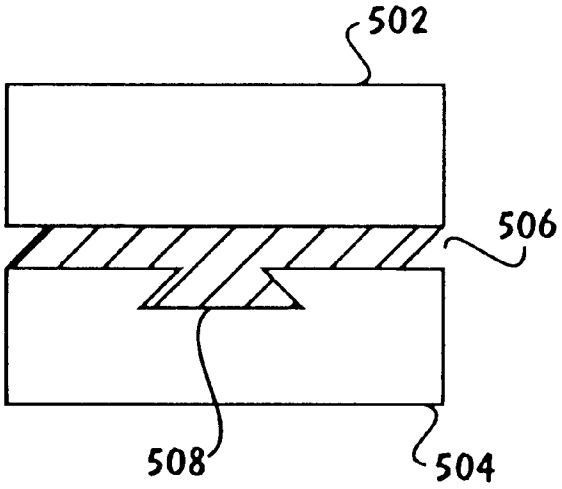
FIGS. 5A and 5B is a cross-sectional view of a retaining ring adhesively attached to a stiffening ring in accordance with the present invention.
Figure 5A:
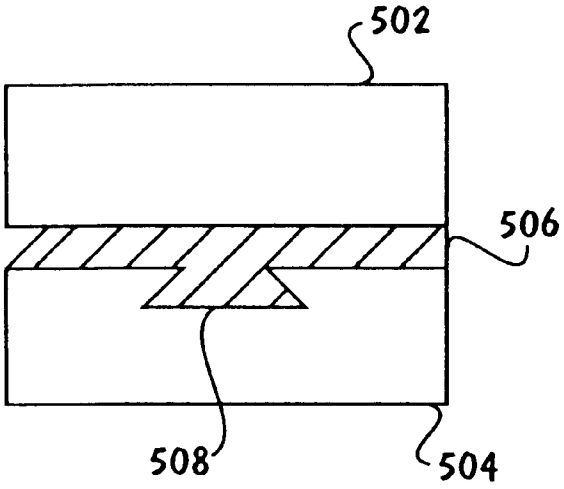

Referring to FIG. 5, a retaining ring and backing plate subassembly is shown where the two elements are held together with an adhesive. More particularly, FIG. 5 is a cross-sectional view showing a backing plate 502, a retaining ring 504 and an adhesive layer disposed between retaining ring 504 and backing plate 502. A commonly available adhesive such as 3M DP460 from 3M Corporation may be used. It can be seen that retaining ring 504 has a circumferential channel 508 formed therein. Preferably, as shown in FIG. 5, channel 508 is formed such that the sides of the channel slope underneath the opening at the backside surface of retaining ring 504. In this way a more robust attachment is formed. Alternatively, radial channels can be formed in the back side of retaining ring 504, rather than the circumferential channel shown in FIG. 5.

Method

Figure 6:
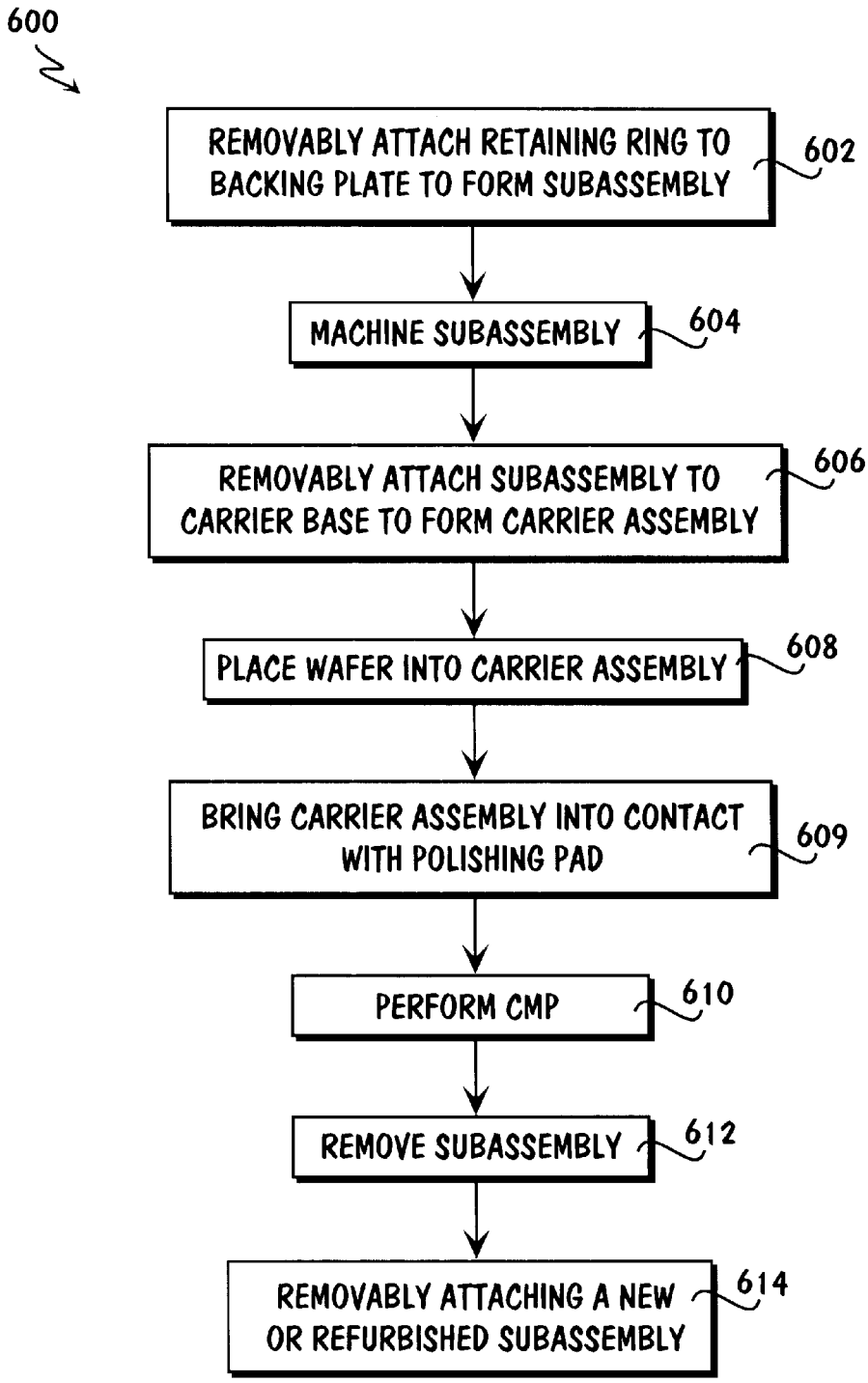
FIG. 6 is a flowchart showing the steps in a process embodying the present invention.

Referring to FIG. 6, a process 600 embodying the present invention is described.

A retaining ring is removably attached 602 to a backing plate to form a retaining ring and backing plate subassembly. The retaining ring has two major surfaces, one being the wear surface, which will be in contact with the polishing pad during CMP, and a back side, or contact surface, which is in contact with the backing plate after the formation of the subassembly. The retaining ring and backing plate subassembly is machined 604 to produce a substantially planar wear surface. The planarized subassembly is removably attached 606 to a carrier base to form a carrier assembly. In alternative embodiments of the present invention, the wear surface includes slots formed in its surface to facilitate the transfer of slurry or liquids to the wafer.

A wafer is placed 608 into the carrier assembly and then brought into contact 609 with the polishing pad. Chemical mechanical polishing 610 of the wafer is then performed.

After some period of use, the retaining ring and backing plate subassembly is removed 612 for servicing, and a new or refurbished retaining ring and backing plate subassembly is removably attached 614 to the carrier base. CMP processing can then continue with only a short down time being required to remove and replace the retaining ring and backing plate subassembly.

A refurbished retaining ring and backing plate subassembly is one in which the worn out retaining ring has been replaced and then machined to planarize its wear surface. Those skilled in the art having the benefit of this disclosure will appreciate that the process of removing the worn retaining ring from the backing plate clearly depends upon how these elements were initially attached. For example, if the retaining ring and backing plate are screwed together, they can be separated by unscrewing, whereas if they have been adhesively attached, they may be separated by treatment with an appropriate solvent or simply mechanically removed.

Conclusion

Embodiments of the present invention provide for reduced costs in manufacturing processes generally, and in semiconductor manufacturing processes in particular.

An advantage of embodiments of the present invention is that anomalies due to uneven retaining ring wear, and flexing of the retaining ring are significantly reduced.

A further advantage of embodiments of the present invention is that the effect of ring dressing on the polishing pad is reduced by maintaining a more consistent alignment of the retaining ring face to the polishing pad surface.

A still further advantage of embodiments of the present invention is that post-assembly lapping procedures, which are costly and tend to embed abrasive residue in the retaining ring, can be reduced or eliminated because retaining rings in accordance with the present invention can be precision machine dressed.

A still further advantage of embodiments of the present invention is that CMP tool down time is reduced because the retaining ring can be replaced without removing the carrier from the tool.

It will be apparent to those skilled in the art a number of variations or modifications may be made to the illustrative embodiments described above. For example, the outer surface of the retaining ring, while typically circular, could be polygonal.

Many other modifications to the specifically described apparatus and process will be readily apparent to those skilled in the art. Accordingly, it is intended that all such modifications and alterations be considered as within the spirit and scope of the invention as defined by the subjoined Claims.

What is claimed is:

1. A method of assembling a carrier assembly, comprising:

removably attaching a retaining ring having a wear surface to a backing plate to form a subassembly;

planarizing the wear surface of the retaining ring; and removably attaching the subassembly to a carrier base to form a carrier assembly;

wherein removably attaching said retaining ring comprises forming a circumferential channel in a back side of the retaining ring, disposing an adhesive between the backing plate and the back side of the retaining ring, such that the circumferential channel is substantially filled with the adhesive when the retaining ring and backing plate are attached.

2. The method of claim 1 wherein the circumferential channel in the back side of the retaining ring has sidewalls which slope such that a distance between the sidewalls at a surface of the retaining ring is less than a distance between the sidewalls at an interior portion of the retaining ring.

3. The method of claim 1, further comprising forming slots on the wear surface.

4. A method of assembling a carrier assembly, comprising:

removably attaching a retaining ring having a wear surface to a backing plate to form a subassembly;

planarizing the wear surface of the retaining ring; and removably attaching the subassembly to a carrier base to form a carrier assembly;

wherein removably attaching comprises forming a plurality of radial channels in a back side of the retaining ring, disposing an adhesive between the backing plate and the back side of the retaining ring, such that the plurality of radial channels are substantially filled with the adhesive when the retaining and backing plate are attached.

5. The method of claim 4, further comprising forming slots on the wear surface.

6. A carrier assembly for chemical mechanical polishing (CMP) comprising:

a backing plate;

a retaining ring removably attached to the backing plate;

a carrier assembly base; and an adhesive disposed between the backing plate and the retaining ring;

wherein the retaining ring has a channel therein, the channel having sloping sidewalls and the adhesive being disposed substantially in the channel.

7. The carrier assembly of claim 6, wherein the channel sidewalls slope outwardly such that a width of the channel is greater at a surface of the channel than at a bottom of the channel.

* * * * *